US007221350B2

(12) United States Patent
Wu et al.

(10) Patent No.: US 7,221,350 B2
(45) Date of Patent: May 22, 2007

(54) METHOD OF REDUCING FLICKERING AND INHOMOGENEOUS BRIGHTNESS IN LCD

(75) Inventors: Biing-Seng Wu, Hsin-Shih Village (TW); Wen-Jyh Sah, Hsin-Shih Village (TW); Chao-Wen Wu, Hsin-Shih Village (TW)

(73) Assignee: Chi Mai Optoelectronics Corp. (TW)

( * ) Notice: Subject to any disclaimer, the term of this patent is extended or adjusted under 35 U.S.C. 154(b) by 1074 days.

(21) Appl. No.: 09/826,096

(22) Filed: Apr. 5, 2001

(65) Prior Publication Data

US 2001/0028337 A1 Oct. 11, 2001

(30) Foreign Application Priority Data

Apr. 6, 2000 (TW) ..... 89106352 A

(51) Int. Cl.
*G09G 3/36* (2006.01)

(52) U.S. Cl. ..... 345/92; 345/93

(58) Field of Classification Search ..... 345/82, 345/83, 87, 88, 89, 90, 91, 92, 93, 94, 95–100, 345/204; 327/91, 141
See application file for complete search history.

(56) References Cited

U.S. PATENT DOCUMENTS 4,406,997 A * 9/1983 Depp et al. ..... 345/205
5,278,086 A * 1/1994 Tomes et al. ..... 438/27
5,475,396 A * 12/1995 Kitajima et al. ..... 345/92
5,497,146 A * 3/1996 Hebiguchi ..... 340/14.63
5,534,860 A * 7/1996 Phillips et al. ..... 341/22
5,614,730 A * 3/1997 Nakazawa et al. ..... 257/59
6,124,840 A * 9/2000 Kwon ..... 345/100
6,259,425 B1 * 7/2001 Shimizu ..... 345/94
6,421,038 B1 * 7/2002 Lee ..... 345/98
6,462,724 B1 * 10/2002 Ozawa et al. ..... 345/87
6,493,047 B2 * 12/2002 Ha ..... 349/40
6,914,643 B1 * 7/2005 Nagase et al. ..... 349/40

* cited by examiner

*Primary Examiner*—Nitin Patel

(57) ABSTRACT

A method of reducing flickering and inhomogeneous brightness in an LCD. The method serially connects each scan line connecting a plurality of pixels in a row with a resistor to form a scan line circuit. The resistor is connected between the first pixel of the scan line and the voltage input terminal of the scan line, so that the gate voltage entering the TFT in the first pixel deforms. The voltage of the TFT decreases when it is turned off, minimizing screen flickering and inhomogeneous brightness due to the capacitor charge coupling effect between the first pixel and the last pixel on a scan line.

10 Claims, 5 Drawing Sheets

METHOD OF REDUCING FLICKERING AND INHOMOGENEOUS BRIGHTNESS IN LCD

BACKGROUND OF THE INVENTION

1. Field of Invention

The invention relates to a TFT scan line control circuit for LCDs and, in particular, to a circuit that solve the problems of flicker and inhomogeneous brightness in LCDs.

2. Related Art

The LCD (Liquid Crystal Display) is a flat display with low power consumption. In comparison with the CRT (Cathode Ray Tube) of the sane screen size, the LCD is much smaller in its space occupation and weight. Unlike the curved screen in conventional CRTs, it has a planar display screen. With these advantages, LCDs have been widely used in various products, including palm calculators, electronic dictionaries, watches, mobile phones, notebook computers, communication terminals, display panels or even personal desktop computers. In particular, there is tendency that the TFT-LCD (Thin Film Transistor Liquid Crystal Display) is gradually replacing the low-level STN-LCD due to its superior properties in visible angles, contrast, and response time.

As shown in FIG. 1, there are liquid crystal capacitors 100 and transistors 110 disposed in an array. Scan lines 120 connect the gates 111 of the transistors 110. Data lines 130 connect the sources 112 of the transistors 110. Each liquid crystal capacitor 100 connects between a transistor 110 and a reference potential 115. Each scan line 120 imposes in order a rectangular voltage on the gate 111 of the transistor 110 at an interval of roughly a scanning time, which is a positive frame time divided by the number of scan lines. At the moment, the voltages D1, D2 and D3 are existent on the data lines 130. The corresponding charges are then stored in the crystal capacitors 100 at the intersection of the data lines 130 and each scan line 120 in order at times t1, t2, and t3. The shaded squares 140 in the drawing schematically explain the data storage of the rectangular waves on the data lines and the scan lines.

With further reference to FIG. 1, aside from the transistors 110 and the crystal capacitors 100 connected by the scan lines 120, there are also stray capacitors 116 and resistors 121. For currently available LCDs with a resolution of 1024×768, 1024×3 data lines are required, where the factor 3 accounts for the red, green and blue color signals for a point. The resistance 121 is generated by the generic resistance in thin and long wires (10 μm×12–14 in.). The resistance is about 0.35Ω/sq. The above-mentioned resistors 121 and the stray capacitors 116 definitely cause RC time delays. Therefore, even each scan line 120 is input with a rectangular wave that is steep at its edges, as shown in FIG. 2*a*, the voltage imposed on the gate of the first pixel transistor (composed of a transistor 111 and a liquid crystal capacitor 100) is almost invariant in its shape (FIG. 2*b*). However, on the n'th pixel, the voltage imposed on the gate has some shape deformation.

The voltages $V_{GH}$ and $V_{GL}$ in FIG. 3*a* are the maximum and minimum voltages at the gate of the first pixel. FIG. 3*b* shows that the starting (the transistor turned on) time and the decreasing (the transistor turned off) time of the scan line rectangular wave at the gate of the last pixel. Therefore, to respond such a change in the waveform, the usual scan line and data line produce a time difference Δt on purposes, as shown in FIG. 3*c*. That is, the data line has to wait until the previous scan line is turned off before it writes the data signals while the next scan line is turned on.

Since there is an unavoidable parasitic capacitor $C_{GS}$ between the TFT source/drain and gate and $C_{GS}$ is pretty large, although $C_{GS}$ does not generate any influence when the transistor is turned on, it does generate the charge coupling effect when the transistor is turned off after writing data into the liquid crystal capacitor $C_{LC}$ and a storage capacitor $C_S$. FIG. 4 shows that the voltage at the drain of the transistor drops from $V_D$ by $\Delta V_D$ to $(V_D-\Delta V_D)$ 142. This voltage is maintained till the end of the positive frame time, which is about 16.7 ms. The $\Delta V_D$ is $C_{GS}(V_{GH}-V_{GL})/(C_{GS}+C_S+C_{LC})$. To prevent decomposition of the liquid crystal from, a negative frame time (when the voltage $V_D$ is negative) has to be imposed after a frame time (when the voltage $V_D$ is positive). At this moment, the charge coupling effect due to the capacitor $C_{GS}$ still produces a voltage drop of $\Delta V_D$ to the voltage $-V_D-\Delta V_D$ 144. FIG. 5 illustrates such a situation.

In the n'th pixel of the scan lines, the RC time delay deforms the square waveform of the scan line and makes the capacitor $C_{GS}$ generate the charge coupling effect. Therefore, the gate voltages of the n'th pixel and the first pixel are different, resulting in the flicker problem of a large TFT-LCD. To conquer the above problem, a common method is to change the IC design of the scan line driver. Nevertheless, this will increase the cost and thus is not economical at all. It is thus an object of the invention to provide an effective method that solves the above problem.

SUMMARY OF THE INVENTION

An object of the invention is to provide a method to solve the flickering problem in a large TFT-LCD.

The invention discloses a scan line circuit that solves the problems of screen flickering and inhomogeneous brightness in the LCD. Each scan line circuit contains a scan line connecting the gates of the TFTs of a plurality of pixels in a row and a resistor connecting in series. The resistor is placed between the first pixel on the scan line and the voltage input terminal of the scan line, so that the gate voltage entering the TFT in the first pixel deforms. The voltage of the TFT decreases when it is turned off, solving screen flickering due to the capacitor charge coupling effect between the first pixel and the last pixel on a scan line and, at the same time, the problem of inhomogeneous brightness due to imperfect exposure junctions.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

In view of the foregoing description, due to the RC time delay on the n'th pixel of each scan line, the deformed square waveform voltage input on the scan line and the charge coupling effect produced by the capacitor $C_{GS}$, there is flickering in a large TFT-LCD.

The specification further describes flickering occurred in a TFT-LCD hereinafter and then discloses a method to solve the problem.

Figure 1:
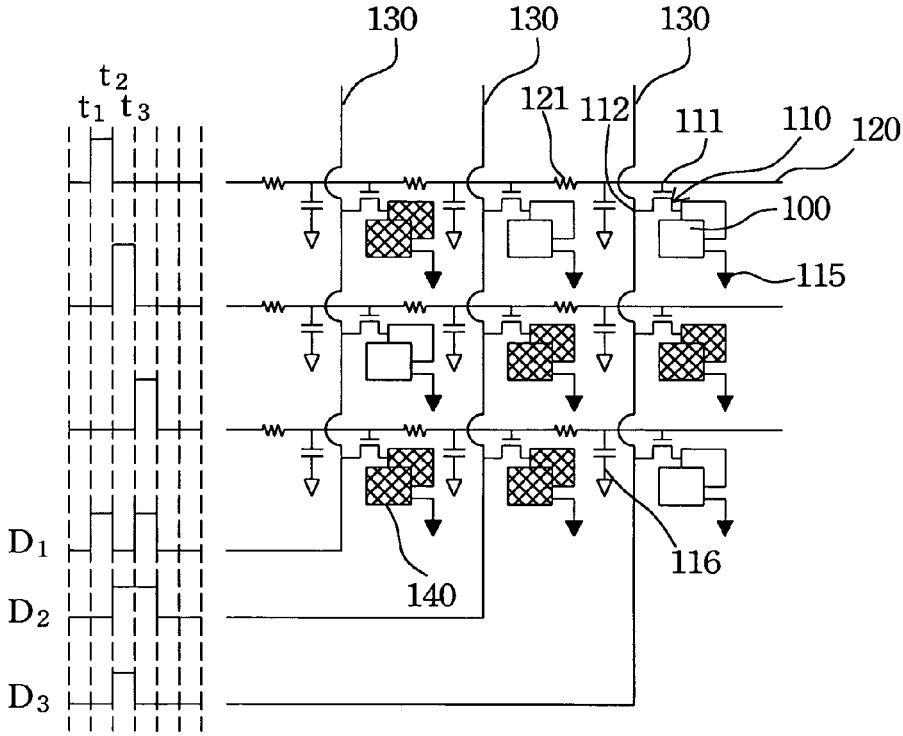
FIG. 1 is a schematic layout of a conventional TFT-LCD.
Figure 2A:
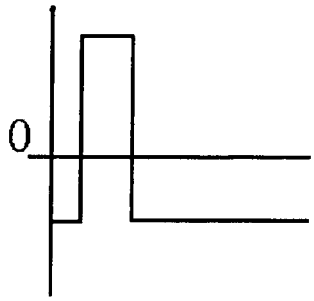
FIGS. 2*a* to 2*c* illustrate the rectangular waveforms when imposing a rectangular waveform voltage on the first pixel and the n'th pixel.
Figure 2B:
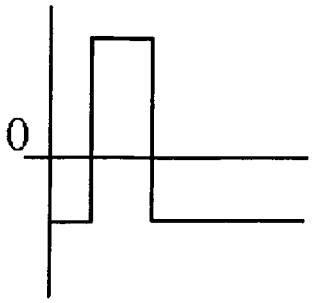
Figure 2C:
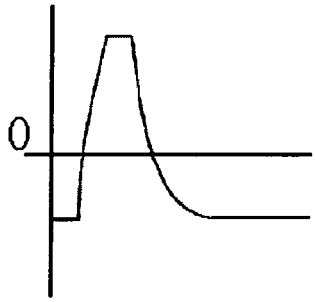
Figure 3A:
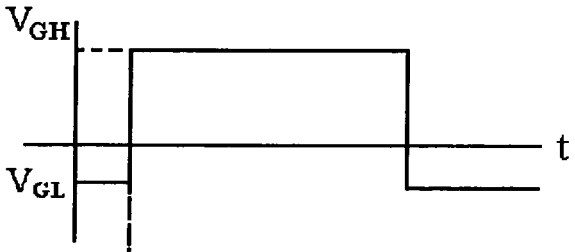
FIGS. 3*a* and 3*b* illustrate the maximum and minimum voltages on the gates of the first pixel and the last pixel, respectively.
Figure 3B:
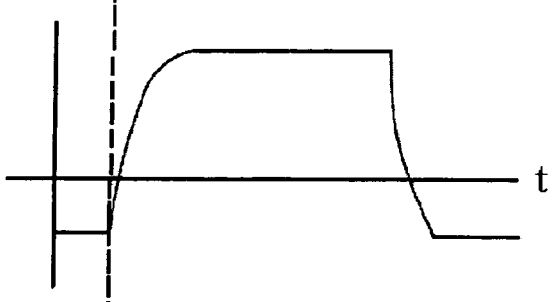
Figure 3C:
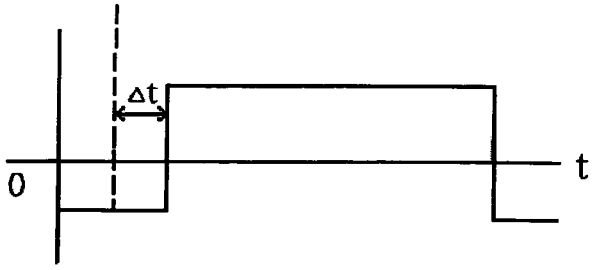
FIG. 3*c* shows that the data line can start to write the data signals from the next scan line only after the previous pixel is turned off because there is a time difference Δt between the scan line and the data line.
Figure 4:
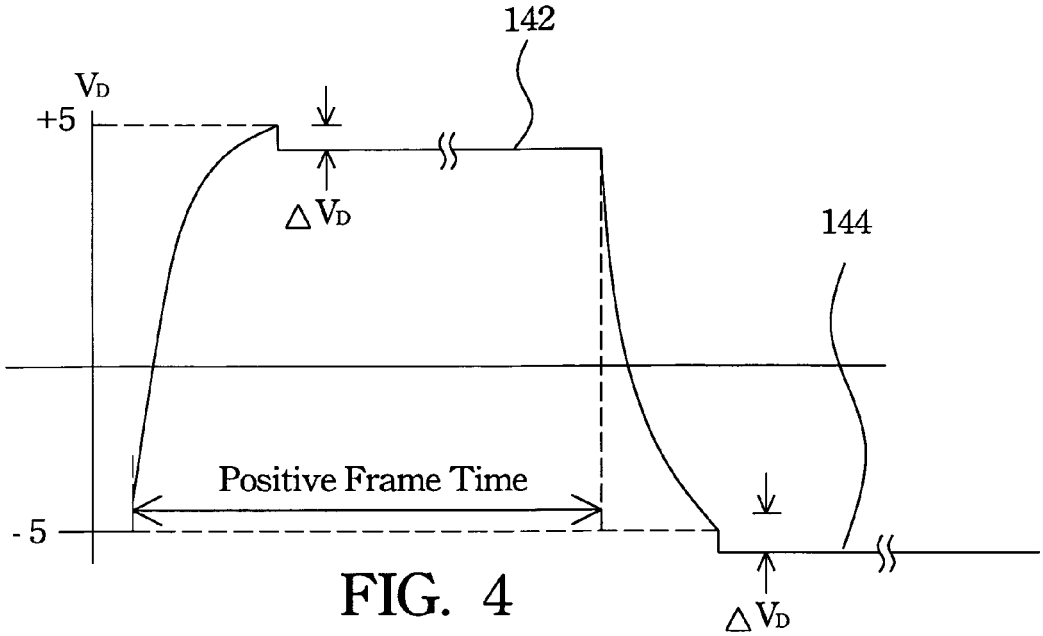
FIG. 4 illustrates the voltage drop $\Delta V_D$ on the drain voltage due to the $C_{GS}$ capacitor coupling effect.
Figure 5A:
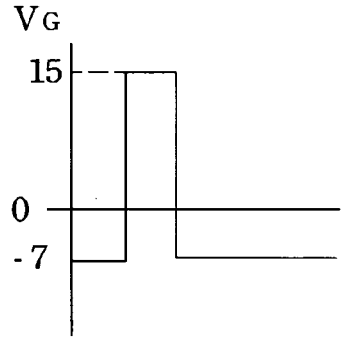
FIG. 5*a* shows a typical rectangular wave voltage input from a scan line.
Figure 5B:
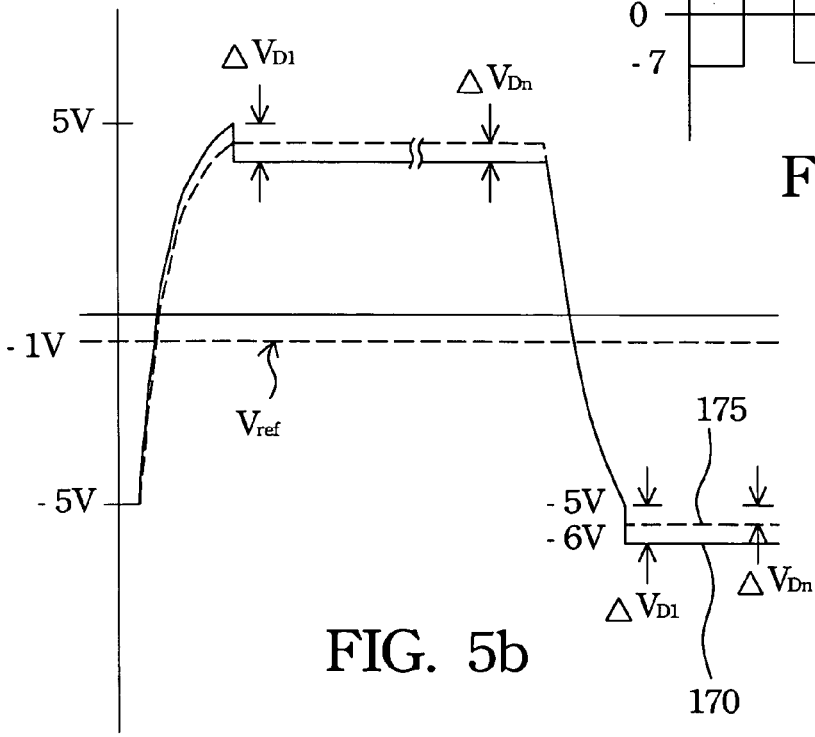
FIG. 5*b* shows a difference between the drain voltages on the first and the last pixels due to the $C_{GS}$ capacitor coupling effect.

With reference to FIG. 5*a*, a typical rectangular waveform voltage entering a scan line has a high voltage $V_{GH}$ of about 15V and a low voltage $V_{GL}$ of about −7V. At this moment, no time delay occurs in the transistor of the first pixel when going from $V_{GH}$ to $V_{GL}$ such that the voltage of the first pixel is the same as that at the input terminal of the scan line. However, due to the charge coupling effect produced by the capacitor $C_{GS}$, the drain voltage $V_D$ of the transistor experiences a voltage drop $\Delta V_{D1}$ when the signal input moves from one scan line to the next scan line during a positive frame time, as shown by the curve 170 in FIG. 5*b*. Thus, the voltage $V_D$ drops from 5V down to 4V. In a negative frame time, the voltage $V_D$ also drops from −5V to −6V due to the charge coupling effect of the capacitor $C_{GS}$. For the liquid crystal, accordingly, the biases of the positive frame time and the negative frame time are different. This affects the brightness of the display so that it is brighter in the positive frame time than in the negative frame time. Therefore, the reference voltage has to be adjusted. In the current embodiment, for example, if the reference voltage is adjusted to −1V, the DC bias of the liquid crystal in the positive and negative frame times become very close to each other. As shown by the curve 175 in FIG. 5*b*, when the scan line transmits the signal to the n'th pixel, the RC time delay for the scan line square wave voltage to change from $V_{GH}$ to $V_{GL}$ is very significant for a large size LCD (e.g. a 10 μm×14 in. metal scan line). The scan line square wave seriously deforms. Therefore, in the positive frame time, the voltage is $V_T$ when the transistor of the n'th pixel is turned off, where $V_T$ is the threshold voltage when the TFT is turned off. Due to the charge coupling effect, the voltage is dropped by $\Delta V_{Dn}$ to become $C_{GS}(V_T-V_{GL})/(C_{GS}+C_S+C_{LC})$. Since $V_T<V_{GH}$, $\Delta V_{Dn}$ is smaller, e.g. 0.5V. In the negative frame time, it is also decreased by 0.5V. Therefore, such a 0.5V difference results in the difference of the biases of the positive and negative frame times. The bias is larger in the positive frame time (low brightness) and smaller in the negative frame time (high brightness). Flicker thus takes place on the liquid crystal display.

Using the conventional method described in prior art to solve the problem of flickering is very difficult. It is because one needs to modify the IC design of the scan line driver. Not only are the effects bad, the main reason is that the cost of the scan line driver manufacturers increases because of different capacitors required by different LCD manufacturers.

Figure 6:
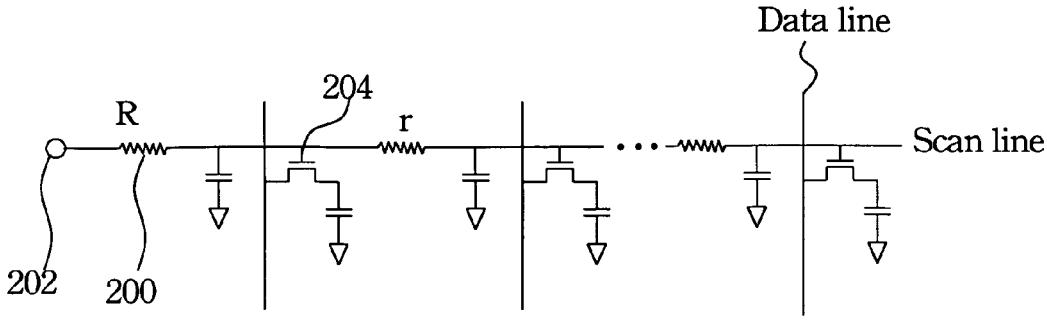
FIG. 6 shows an equivalent circuit of the scan line with a resistor made of ITO added between the scan line voltage input terminal and the first pixel gate in a TFT-LCD according to a first preferred embodiment of the invention.

FIG. 6 shows an equivalent circuit of the scan line a resistor 200 made from ITO installed between the scan line voltage input terminal 202 and the first pixel gate 204 in a TFT-LCD according to a first preferred embodiment of the invention. The voltage drop $\Delta V_{D1}$ and $\Delta V_{Dn}$ at the first and the n'th pixels, respectively, due to the charge coupling effect then become closer.

Figure 7A:
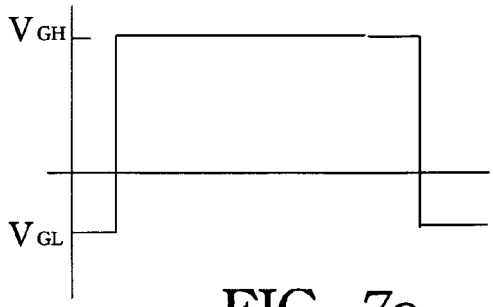
FIG. 7*a* shows a square voltage at the scan line input terminal.
Figure 7B:
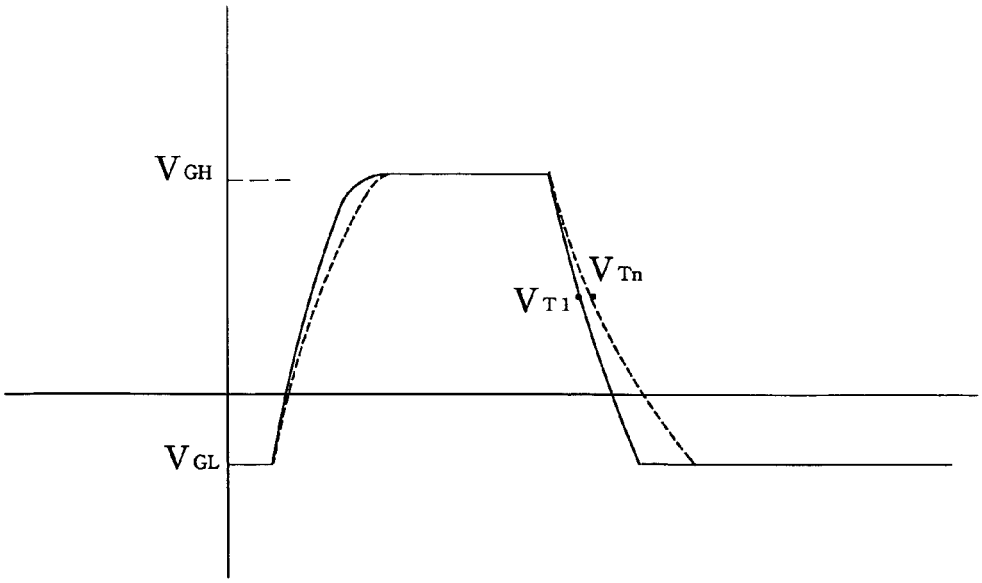
FIG. 7*b* shows the scan line voltage of transistor gate of the first pixel and the scan line voltage of transistor gate of the last pixel according to the equivalent circuit in FIG. 6.

With reference to FIGS. 7*a* and 7*b*, since a resistor 200 with a resistance of about 10–100Ω/sq is provided to each scan line before connecting to the first pixel transistor, there is a time delay in the scan line voltage drop even at the transistor gate of the first pixel. Therefore, the turn-off time of the first pixel transistor is not the time when the scan line signal is removed, but at a later time when the voltage reaches $V_{T1}$. Therefore, the difference between $V_{T1}$ and $V_{Tn}$ becomes smaller so that the voltage drop $\Delta V_{D1}$ of the first pixel transistor and $\Delta V_{Dn}$ of the n'th pixel transistor become closer.

Please refer again to FIG. 7*b*. For example, when no resistor is installed, $V_{GH}-V_{GL}=15V-(-7V)=22V$. After inserting ITO resistor 200, $V_{GH}$ becomes $V_{T1}$. At the moment, if $V_{T1}$ is 7V, then $V_{T1}-V_{GL}=7V-(-7V)=14V$. Thus, the voltage drop $\Delta V_{D1}$ of the first pixel transistor and $\Delta V_{Dn}$ of the n'th pixel transistor become closer. This decreases screen flickering.

Figure 8:
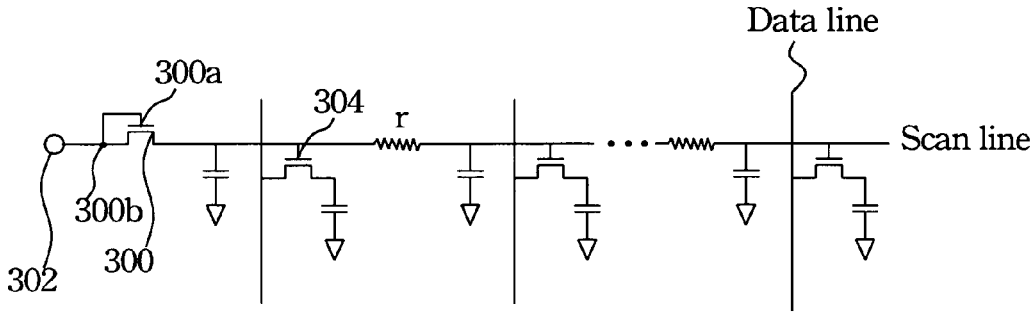
FIG. 8 shows an equivalent circuit of the scan line wherein a thin film transistor with source/gate connection is connected between the scan line voltage input terminal and the first pixel gate in a TFT-LCD according to a second preferred embodiment of the invention.

FIG. 8 shows an equivalent circuit of the scan line wherein a TFT 300 with source/gate connection is connected between the scan line voltage input terminal 302 and the first pixel gate 304 in a TFT-LCD according to a second preferred embodiment of the invention. The source 300*a* and the gate 300*b* of the TFT 300 are connected so that they have the same electric potential. When the voltage input terminal 302 imposes a positive voltage at the source 300*a*, the gate 300*b* also opens so that the current can flow through the TFT 300. Inserting the TFT 300 with connection of source and gate before the first pixel gate 304, the decrease and waveform deformation of the voltage at the first pixel gate can achieve the one shown in FIG. 7*b*, shortening the difference between $V_{T1}$ and $V_{Tn}$, improving the screen flickering phenomena.

Moreover, since the LCD is a large area display, the exposure in the photolithography procedure for making source/drain areas can not be done in one step. The exposure is done by one image field after another. Since the LCD manufacture procedure does not allow alignment marks between the image fields, errors of the gate and source/drain in one transistor between different image fields is unavoidable. Therefore, the capacitor $C_{GS}$ varies, resulting in changing $\Delta V_D$. The variation of $\Delta V_D$ causes the so-called shut mura, meaning imperfect exposure junctions and inhomogeneous brightness.

The invention can use the thin film resistor made by ITO or the TFT with source/gate connection to bring $V_{T1}$ and $V_{Tn}$ closer, solving the shut mura problem. Thus, the disclosed method can significantly decrease the cost and improve the problems of screen flickering and inhomogeneous brightness.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A scan line circuit that solves screen flicker, imperfect exposure junctions and inhomogeneous brightness in a TFT-LCD, which includes a plurality of perpendicular scan lines and a plurality of horizontal data lines, each of the scan lines connecting a plurality of pixel TFTs in a row and each of the data lines connecting a plurality of pixel TFTs in a column to form an array of the pixel TFTs, and a drain of the each pixel TFTs connecting a liquid crystal capacitor and a storage capacitor, wherein each of the scan line comprises:

gate voltage deformation means for deforming a gate input voltage waveform input from an input terminal of the scan line, the gate voltage deformation means located only between the gate of the first pixel TFT in the row and the input terminal of the scan line.

2. The circuit of claim 1, wherein the gate voltage deformation means comprises a resistor.

3. The circuit of claim 2, wherein the resistance of the resistor is in the range between 10 Ω/sq and 100 Ω)/sq.

4. The circuit of claim 1, wherein the gate voltage deformation means comprises an ITO thin film.

5. The circuit of claim 1, wherein the gate voltage deformation means comprises a TFT that the TFT's gate connects the TFT's source directly.

6. A scan line circuit that solves screen flicker, imperfect exposure junctions and inhomogeneous brightness in a TFT-LCD, which includes a plurality of perpendicular scan lines and a plurality of horizontal data lines, each of the scan lines connecting a plurality of pixel TFTs in a row and each of the data lines connecting a plurality of pixel TFTs in a column to form an array of the pixel TFTs, and a drain of the each pixel TFTs connecting a liquid crystal capacitor and a storage capacitor, wherein each of the scan line comprises:

gate voltage deformation means for, generating a deformed gate voltage waveform transmitted to the pixel TFTs connected to the same scan line, the gate voltage deformation means located between the gate of the first pixel TFT in the row and the input terminal of the scan line.

7. The circuit of claim 6, wherein the gate voltage deformation means comprises a resistor.

8. The circuit of claim 7, wherein the resistance of the resistor is in the range between 10 Ω/sq and 100 Ω/sq.

9. The circuit of claim 6, wherein the gate voltage deformation means comprises an ITO thin film.

10. The circuit of claim 6, wherein the gate voltage deformation means comprises a TFT that the TFT's gate connects the TFT's source directly.

* * * * *

UNITED STATES PATENT AND TRADEMARK OFFICE

CERTIFICATE OF CORRECTION

PATENT NO. : 7,221,350 B2
APPLICATION NO. : 09/826096
DATED : May 22, 2007
INVENTOR(S) : Wu et al.

It is certified that error appears in the above-identified patent and that said Letters Patent is hereby corrected as shown below:

Cover page, Item (73) Assignee:

Please amend Assignee's name as follows from "Chi Mai Optoelectronics" to --CHI MEI OPTOELECTRONICS CORP.--

Column 6, Line 9 of Claim 6:

Please amend the Line 9 as follows from:
"gate voltage deformation means for, generating a" to --gate voltage deformation means for generating a--

Signed and Sealed this

Sixth Day of November, 2007

JON W. DUDAS
*Director of the United States Patent and Trademark Office*